US005461979A

United States Patent [19]

Bruni

[11] Patent Number: 5,461,979

[45] Date of Patent: Oct. 31, 1995

[54] MULTIPLE BLADE INK KNIFE

[75] Inventor: Hanspeter Bruni, Welsikon-Dinhard, Switzerland

[73] Assignee: Bruni AG Grafische Maschinen, Andelfingen, Switzerland

[21] Appl. No.: 132,060

[22] Filed: Oct. 5, 1993

[30] Foreign Application Priority Data

Oct. 19, 1992 [CH] Switzerland ..... 03236/92

[51] Int. Cl.[6] ..... B41F 31/04; B41F 31/06

[52] U.S. Cl. ..... 101/365

[58] Field of Search ..... 101/350, 365, 101/363, 364, 207–210, 157, 169; 118/261; 15/256.51

[56] References Cited

U.S. PATENT DOCUMENTS

| | | | |
|---|---|---|---|
| 4,400,240 | 8/1983 | Abendroth | 202/248 |
| 4,413,561 | 11/1983 | Toyoda | 101/365 |
| 4,414,300 | 11/1983 | Kraus et al. | 101/363 |
| 4,414,890 | 11/1983 | Schiel et al. . | |
| 4,495,864 | 1/1985 | Junghans | 101/365 |
| 4,553,477 | 11/1985 | Witczak . | |
| 4,624,183 | 11/1986 | Kunkel et al. | 101/365 |
| 4,773,327 | 9/1988 | Moetteli | 101/365 |
| 4,991,504 | 2/1991 | Fina | 101/208 |

FOREIGN PATENT DOCUMENTS

| | | | |
|---|---|---|---|
| 0052196 | 5/1982 | European Pat. Off. . | |
| 2411771 | 9/1974 | Germany . | |
| 2437584 | 5/1975 | Germany . | |
| 602345 | 7/1978 | Switzerland . | |
| 658626 | 11/1986 | Switzerland . | |
| 2156276 | 10/1985 | United Kingdom | 101/365 |

*Primary Examiner*—J. Reed Fisher
*Attorney, Agent, or Firm*—Bachman & LaPointe

[57] ABSTRACT

A knife designed as a flexible steel plate for the ink ducts of an offset printing machine has blades in the area of the working edge which can be bent differently in zones against an ink ductor by individually adjustable regulator elements. The multiple blade ink knife designed as an autonomous unit. It comprises two-part side jaws attached on both sides to a knife holder, each with an outer metal jaw and an inner plastic jaw which presses resiliently against the front of the ink ductor and the knife. This suitably has a groove, recessed at least in the area of the knife dipped into an ink bath, which is filled with an elastic sealant. At least the blades of a knife designed as a flexible metal plate, also an autonomous unit, are fully covered on the top with a flexible metal strip applied by adhesive.

14 Claims, 5 Drawing Sheets

MULTIPLE BLADE INK KNIFE

Figure 1:
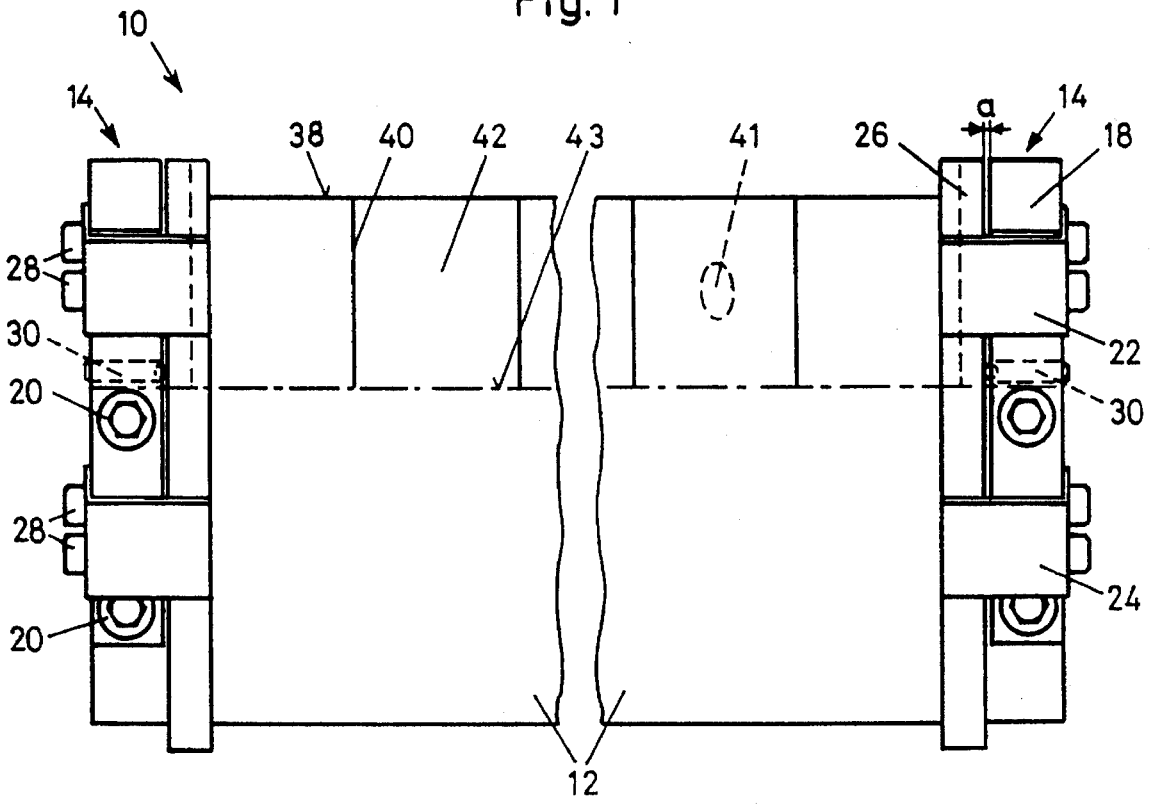

The invention relates to a multiple blade ink knife for the ink ducts of an offset printing machine, where a knife in the form of a flexible steel plate is bent differently in zones against an ink ductor by regulator elements arranged on each blade, and to a knife in the form of a flexible steel plate.

Multiple blade ink knives are known for example from CH,A5 602345, which are known as ink knives for the ink duct roller. This ink knife has in the area of the working edge recesses which are divided on both sides by adjacent adjustment screws. The blades thus formed can be adjusted individually, while influence on the adjacent knife sections is excluded or at least considerably reduced. The thickness of the ink layer can be set on each blade using the adjustment screws; individual ink applications in the different ink zones can be set as the printing image in the different width areas requires. A disadvantage with this solution is the spaces between the blades, which allow ink through such that rings can appear on the ink ductor.

The escape of ink between the blades is prevented for example according to CH,A5 658626 in that the multiple blade ink knife, known as a measuring knife, is divided into blades at least 3 mm thick which can bend parallel to a roller, with groove shaped spaces formed with a membrane-like divider. Using such a measuring knife, the individual blades can be set individually via regulator elements but the intervening space remains impermeable to ink due to the divider. Creation of the grooves between the blades however appears to be very complex and expensive.

EP, A1 052196 describes an ink duct for a printing machine in which the ink knife is longer than the ink duct roller. The side walls each consist of a fixed part and an elastic part which lies against the front of the ink duct roller and which is compressed by resilient adjustment screws. A further resilient element can press the inner part of the side walls against the long side of the extended ink knife.

Each individual blade of an ink knife can be set accurately, quickly and reproducibly with a regulator element designed in the simplest case as an adjustment screw. The ink metering can be set accurately manually or automatically, and all influence on neighboring zones is prevented.

The ink duct of an offset printing machine is sealed in the axial direction of the ink ductor by side jaws attached to the machine frame. This sealing function must be created each time the knife is used, according to the current state of the art. The running surface of the ductor is fitted in a corresponding recess of the side jaw attached to the machine frame, thus largely preventing the escape of ink.

With regard to the production tolerances on the length of the ink ductor and knife, which can amount to a few tenths of millimeters, and the operating comfort, the known systems with interchangeable multiple blade ink knives and side jaws rigidly attached to the machine frame are not satisfactory.

The task of the inventor is therefore to create a multiple blade ink knife of the type described above, which not only gives clean zoned ink metering but also is easy to mount, with a good seal in the side area and in the area between the blades.

The task relating to the side seal is solved by the invention in that the multiple blade ink knife is designed as an autonomous unit with two-part side jaws attached on both sides to a knife holder, where the side jaws each have an outer metal jaw and an inner plastic jaw which presses resiliently against the front of the ink ductor and also against the front of the knife. Special further developments of the multiple blade ink knife are described herein below.

Within the present invention, an autonomous unit with two-part side jaws for use in an ink duct is known for the sake of simplicity, after its functional main component, as a multiple blade ink knife.

A perfect seal on the front of the ink ductor is made possible by the resiliently-mounted plastic jaws which compensate easily for deviations in the said production tolerances. The tiresome side escape of ink is prevented completely. Each multiple blade ink knife has sealed and individually adjustable side jaws, which are part of the autonomous unit and can be removed therefrom, for example for regrinding the knife and/or rollers.

An optimum seal at the front of the ductor and on the knife is preferably achieved by a groove in the plastic jaw, recessed in the area of the knife and with an elastic sealant. The knife can be pressed to varying depths in this sealant.

The elastic sealant can be poured in, but alternatively shaped as a profile for insertion in or removal from the groove.

The groove and corresponding elastic sealant are preferably designed 1 to 2 mm wider than the knife. The sealant is preferably designed flush, but may also project or be recessed by approximately 1 mm. The sealant suitably consists of rubber or a soft plastic which is easily deformable and chemically resistant.

With regard to the seal in the area between the blades, the task of the invention is solved in that at least the blades of the ink knife are fully covered on the top with a glued-on flexible metal strip. Conventional glues used in metalwork can be used for fixing to guarantee a shear-resistant and permanent fixing.

Like the blades themselves, the metal strip suitably consists of steel, in particular spring steel, with a thickness of approximately 0.2 mm.

The flexibility of the individual blades can be improved by at least one weakening groove running parallel to the working edge. A weakening groove, preferably not exceeding half the thickness of the flexible metal plate of the multiple blade ink knife, known as knife for short, improves the flexibility of the individual blades without loss of performance. A weakening groove is preferably made in the area of the blade attachments. Two weakening grooves are suitably recessed also in this area, opposite each other and correspondingly less deep.

The multiple blade ink knife according to the invention brings perceptible cost savings due to shorter set-up times, constant ink supply, guaranteed continued printing and hence massive reduction in wastage. The resilient plastic jaws need not be adjusted on the machine and, in particular with an elastic sealant in the knife area, completely prevent the side escape of ink. The metal strip on the blades does not detract from their elasticity but prevents the escape of ink between the blades.

A multiple blade ink knife designed as an autonomous unit also can be changed in a very short time, so easily that it can be installed by the offset printer without special knowledge or tools. It goes without explanation that this brings considerable cost savings.

The multiple blade ink knife designed as an autonomous unit and/or the knife designed as a flexible steel plate are equally suitable as equipment for new offset printing machines or for machines to be converted.

One particularly impressive advantage is the combination of an autonomous unit and a knife covered by a metal strip.

Figure 2:
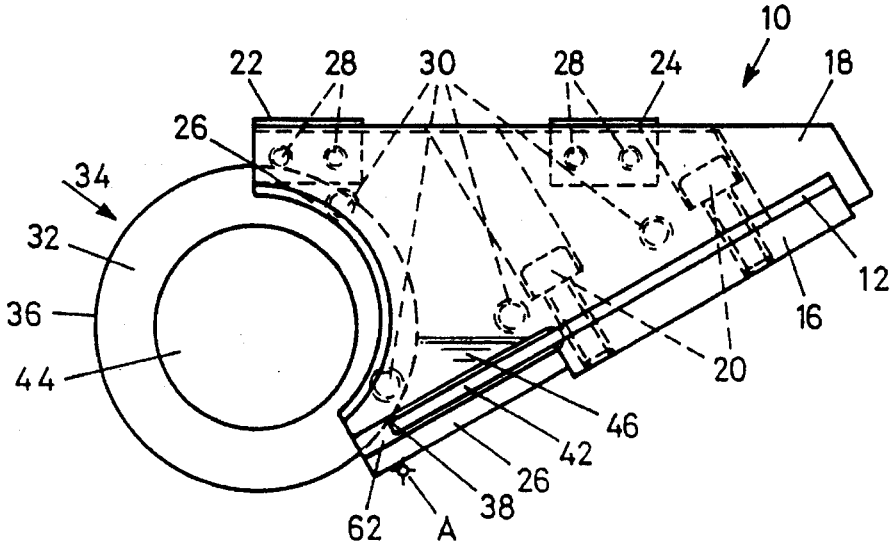
Figure 3:
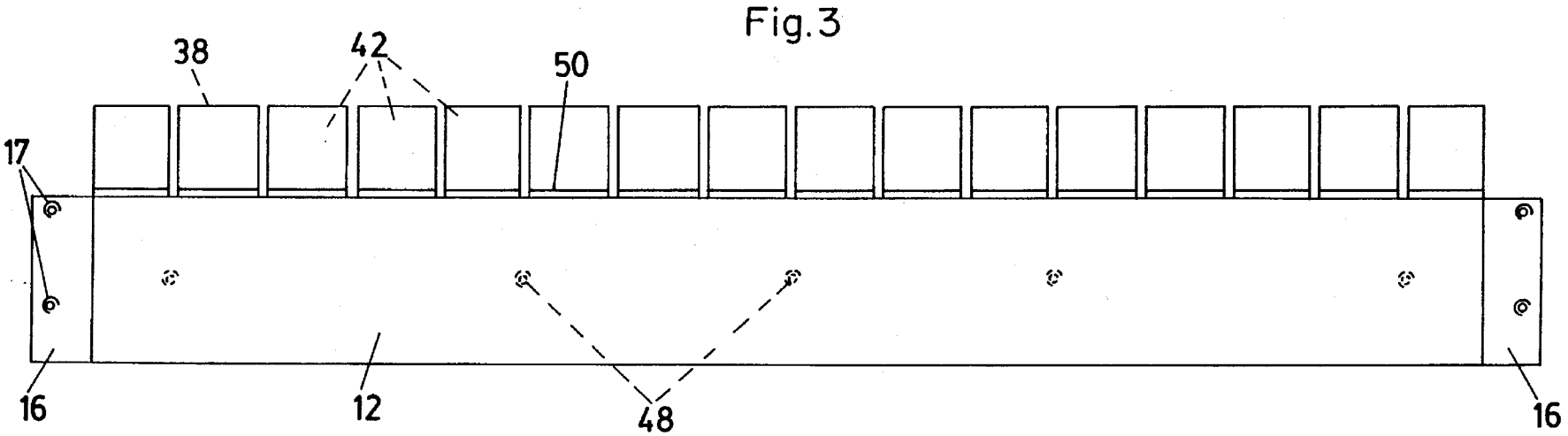
Figure 5:
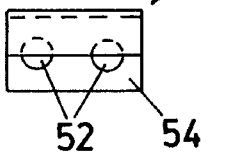
Figure 7:
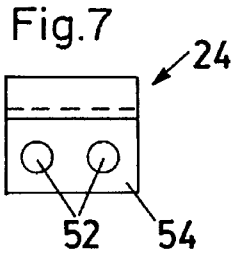
Figure 4:
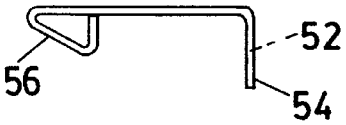
Figure 6:
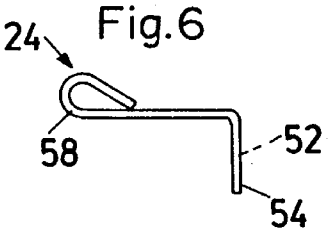
Figure 3A:
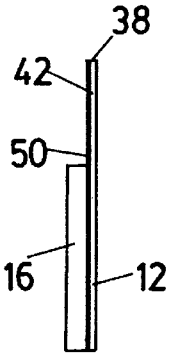
Figure 9:
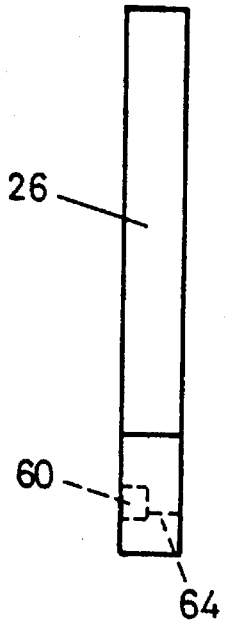
Figure 8:
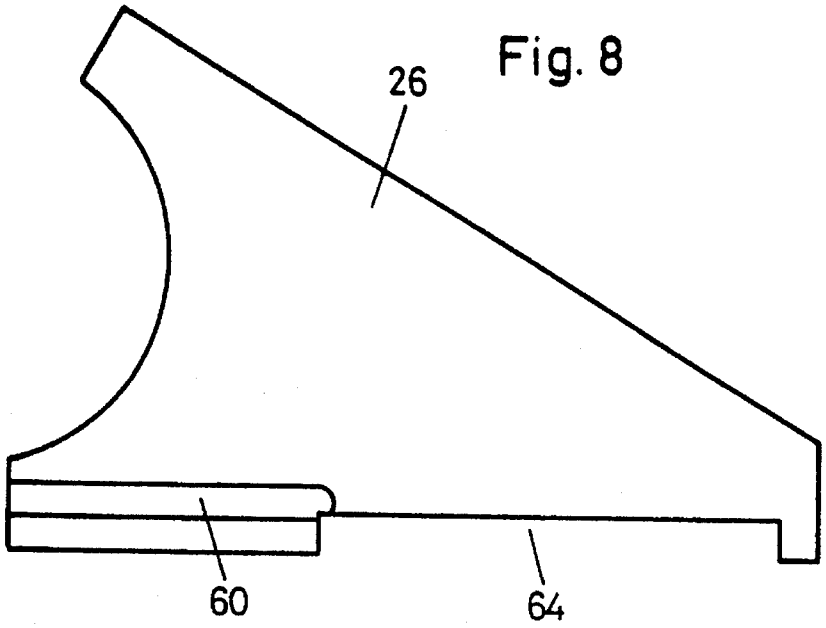
Figure 11:
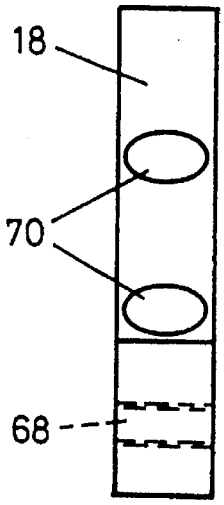
Figure 10:
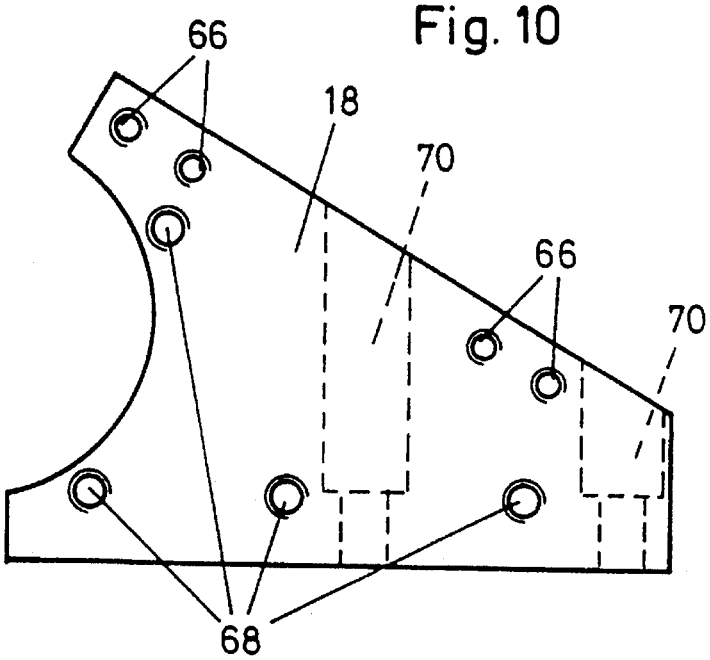
Figure 12:
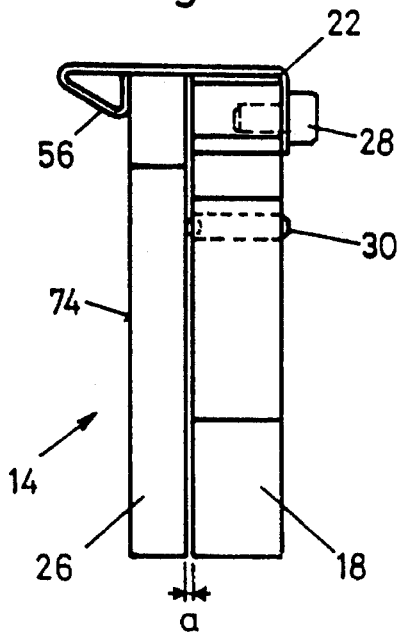
Figure 13:
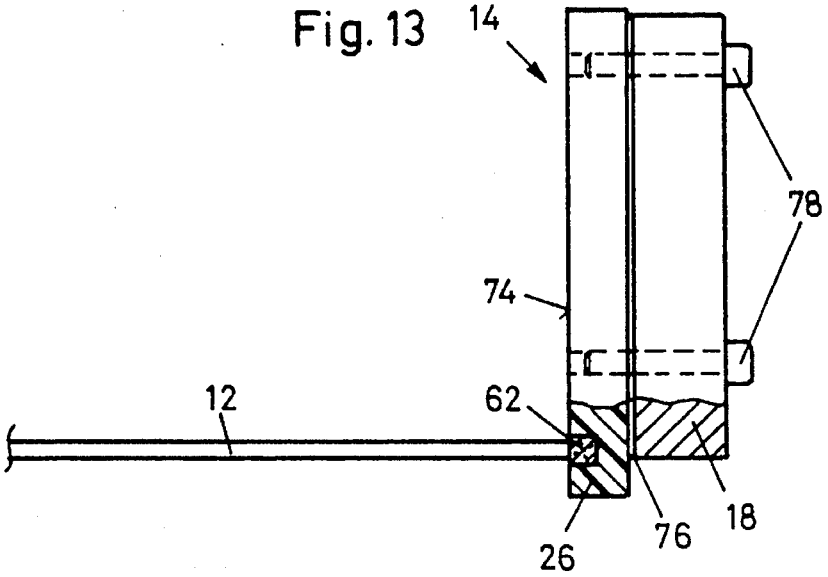
Figure 14:
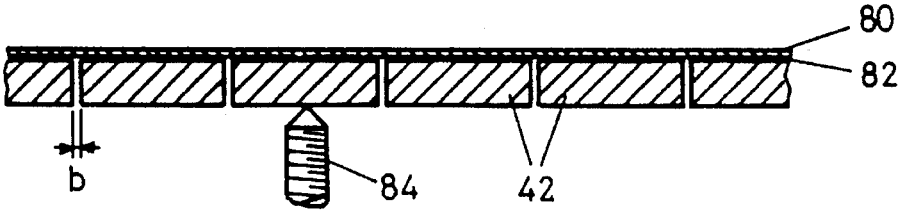
Figure 15:
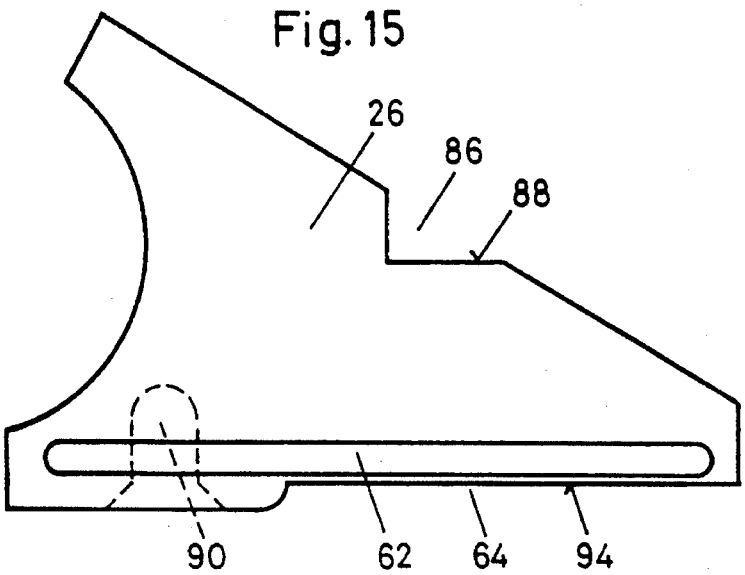
Figure 16:
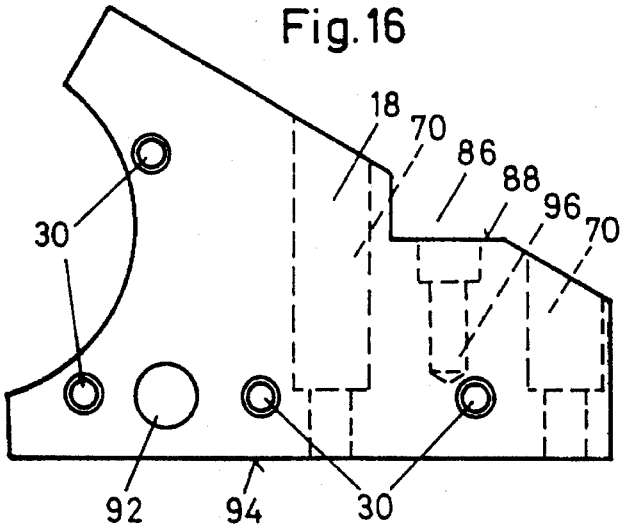
Figure 17:
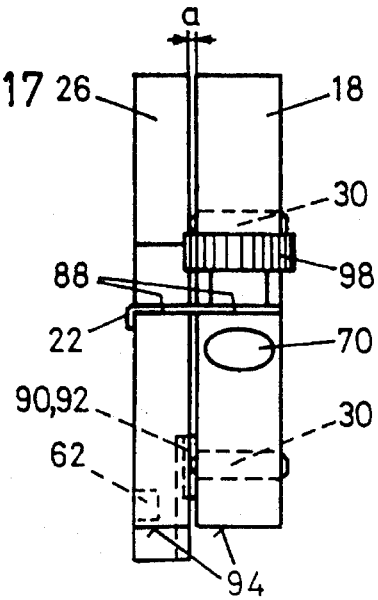

The invention is described in more detail using the design examples shown in the drawing. The diagrams show:

FIG. 1 a top view of a multiple blade ink knife as an autonomous unit, shown shortened FIG. 2 a partial side section of a unit in the working position, FIG. 3 a top view of a multiple blade ink knife without side jaws, FIG. 3*a* a side view of FIG. 3, FIG. 4 a section through a hook clamp, FIG. 5 a front view of the hook clamp in FIG. 4, FIG. 6 a section through a retaining clamp, FIG. 7 a front view of the retaining clamp in FIG. 6, FIG. 8 a front view of a plastic jaw, FIG. 9 a side view of the plastic jaw in FIG. 8, FIG. 10 a front view of a metal jaw, FIG. 11 a side view of the metal jaw in FIG. 10, FIG. 12 a detail of the engagement of the metal and plastic jaw, FIG. 13 a detail of the knife seal, FIG. 14 a longitudinal section through the blades of a knife covered with a steel strip, FIG. 15 a front view of a variant of a plastic jaw, FIG. 16 a front view of a variant of a metal jaw, and FIG. 17 a side view of the combined plastic and metal jaw according to FIG. 16 and 17.

A multiple blade ink knife 10, shown as an autonomous unit in FIGS. 1 and 2, essentially comprises a flexible metal plate 12, also known as a knife, and on both sides two-part side jaws 14. The knife 12 and the side jaws 14 are connected to a knife holder 16 (FIG. 3, 3*a*).

The metal jaws 18 of the side jaws 14 are connected to the knife holder 16 via countersunk screws 20. Hook clamps 22 and retaining clamps 24 hold a plastic jaw 26 resiliently against each metal jaw 18. The connection of clamps 22, 24 with the metal jaw 18 is achieved via screws 28.

According to FIG. 1, the plastic jaw 26 is held against metal jaw 18 with resilient domed screws 30. The four resilient domed screws 30, the position of which is shown in FIG. 2, set a distance a of for example approximately 1 mm. When the autonomous unit is inserted in the offset printing machine, the plastic jaws 26 are moved less than the distance a towards their allocated metal jaw 18, where the resistance of the resilient domed screws 30 must be overcome. This presses the plastic jaw 26 against the face 32 of ink ductor 34, allowing a perfect seal. In the present case, the four resilient domed screws 30 press the plastic jaw 26 against the ink ductor 34 with a force totalling approximately 1 kp.

The metal plate 12 of the multiple blade ink knife 10 (the knife) is divided, in the area of the working edge 38 set against the running surface 36 of ink ductor 34 or pressed in its vicinity, into blades 42 by perpendicular cut-outs 40 of equal length. The individual blades 42, suitably of the same width, can each be bent elastically along the dotted line 43 by a corresponding regulator element. In one blade 42, the support area 41 of a regulator element lying below the knife 12 is shown. The regulator element may be a simple adjustment screw or further developed known manual or automatic regulator elements.

FIG. 2 shows that the side jaw, consisting of metal jaw 18 and plastic jaw 26, has clearance in the area of the roll neck 44 of the ink ductor 34. The visible part segment of plastic jaw 26 lies to the front 32 of ductor 34 and ensures a side seal; the tensioned plastic jaw 26 is compensated in that the resilient domed screws 30 press against the plate.

In the area of knife 12 with blades 42, the plastic jaw 26 has a groove with a sealant 62, on which rests knife 12.

In the lowest area of the unit is shown an ink bath 46 which is perfectly sealed according to the invention. In summary, in the area of the side jaw 14 is a perfect seal never previously achieved, even approximately, which can compensate for length differences between ink ductor 34 and knife 12 within the tolerance range while retaining a good seal and automatically compensates for wear of the plastic jaw 26, which slides only on the front 32 of the ink ductor.

The multiple blade ink knife 10 in the form of an autonomous unit can be folded up by swivelling about an axis A until the knife 12 is approximately horizontal. The unit in FIG. 1 is drawn in this folded position. FIGS. 3, 3*a* show a knife 12 with sixteen blades 42. At both sides, the knife holder 16 is visible with screw holes 17 for fixing the side jaws 14 (FIG. 1). The knife 12 and knife holder 16 are screwed together, as shown by five screw holes 48.

Parallel to working edge 38 at the position of the blade attachments is a weakening groove 50. This groove facilitates individual elastic bending of the blades 42. The residual wall thickness however guarantees sufficient static strength.

FIG. 3*a* shows that the weakening groove 50 is arranged immediately next to the knife holder 16.

The hook clamp 22 shown in FIGS. 4, 5 has an angled leg 54 in the area of screw holes 52. A catchment lug 56 is formed at a spacing corresponding to the thickness of the metal jaw 18 and plastic jaw 26 and space a.

The retaining clamp 24 shown in FIGS. 6, 7 also has an angled leg 54 with screw holes 52 but has no catchment lug 56. Instead, the retaining leg 58 is bent outwards at the free end.

The plastic jaw 26 shown in FIGS. 8, 9, as already stated, has a groove 60 to hold a soft sealant 62 (FIG. 2). For design reasons, groove 60 runs only to a recess 64 which receives the knife holder 16 (FIG. 2) of the autonomous unit.

The metal jaw 18 shown in FIGS. 10, 11, shows all the screw holes, which are recessed for the screws not drawn, the screw holes 66 for the hook and retaining clamps, the screw holes 68 for the resilient domed screws and the screw holes 70 which run parallel to metal jaw 18 for the screws for fixing to knife holder 16.

The function of a hook clamp 22 when screwed to a metal jaw 18 is shown in FIG. 12. The plastic jaw 26 is engaged by the catchment lug 56, when it is held at distance a from the metal jaw 18 against resilient means. Resilient domed screws 30 act on the plastic jaw 26.

When the unit is used, the front 32 of ink ductor 34 (FIG. 2) presses against surface 74 of plastic jaw 26, which slightly reduces distance a.

In the design of FIG. 13, the metal jaw 18 and the plastic jaw 26 are connected together with an intermediate layer of an elastically compressible substance 76, for example a closed-pore elastic plastic, with screws 78 which turn freely in the metal jaw 18.

Knife 12 lies on the sealant 62 which is inserted in groove 60 (FIG. 8) of the plastic jaw 26. As shown, the sealant 62 is flush with surface 74 but it may project or be recessed slightly, eg. up to approximately 1 mm. In this way, the knife 12 can rest absolutely sealed against side jaw 14.

In addition to the sealing of the ink bath 46 (FIG. 2) in the side area in accordance with the invention, the intermediate space b in FIG. 14 must also be sealed suitably between blades 42 so that no ink actually escapes. This can be done in the known manner. Preferably however on the (upper) surface of the blades 42, which are usually 1–3 mm thick, in particular 1.5–2.5 mm thick, is applied a flexible strip 80 as a seal, preferably by means of an adhesive 82. Each blade 42 can be pressed against the running surface 36 of ink ductor 34 by means of a regulator element 84 shown, so that the ink flow can be reduced or even prevented, in zones. The flexible strip of spring steel, for example 0.2 mm thick, can compensate for this shift without essential effect on the adjacent blade 42, and yet prevent the escape of ink between the blades 42.

The plastic jaw 26 shown in FIG. 15 largely corresponds to that shown in FIG. 8. A shoulder 86 forms a support surface 88 for a hook clamp 22 (FIG. 17). A groove (60 in FIG. 8) to support a knife front is filled with a sealant 62. On the back is recessed a guide groove 90 for a guide plate 92 (FIG. 16).

The metal jaw 18 in FIG. 16 essentially corresponds to that shown in FIG. 10. A shoulder 86 forms a support surface 88 which corresponds to that of the plastic jaw 26, ie. the distance from the base 94 is the same in both cases. The screw holes 70 are used to fix the front of the metal jaw 18 to the knife holder 16 (FIG. 3). The resilient screws 30 normally hold the unladen plastic jaw 26 at distance a from metal jaw 18, but give way under pressure. The round plate 92 is pushed into guide groove 90 of the plastic jaw 26 on installation. The shouldered blind hole 96 takes a threaded rod for the manually operated fluted screw 98 shown in FIG. 17.

FIG. 17 shows the resilient fixing of plastic jaw 26 to metal jaw 18, in which the metal guide plate 92 is pushed into guide groove 90 until it stops and the two support surfaces 88 lie flush against each other. The hook clamp 22 with a hole for the threaded rod in the blind hole 96 (FIG. 16) is fixed with the fluted screw 98. So a single hook clamp 22 serves for resilient fixing of the plastic jaw 26.

I claim:

1. Multiple blade ink knife for the ink duct of an offset printing machine, which comprises:

an ink ductor having a front;

a knife divided into multiple blades and having a front and two sides, said knife being in the form of a flexible steel plate which can be bent differently in zones against said ink ductor by regulator elements arranged on each blade;

two-part side jaws with one part on each side of the knife;

a knife holder, with the knife and side jaws connected to the knife holder;

wherein the side jaws each have an outer metal jaw and an inner plastic jaw, with the inner plastic jaw in resilient pressing relationship against the front of the ink ductor and also against the front of the knife; and wherein the multiple blade ink knife together with the side jaws is a complete unit for the ink duct of an offset printing machine.

2. Multiple blade ink knife according to claim 1, including an ink bath communicating with said ink ductor, wherein the plastic jaws have an inside with a groove therein recessed in at least the area of the knife, dipped into the ink bath and filled with an elastic sealant.

3. Multiple blade ink knife according to claim 1, wherein the plastic jaws are held and pressed by elastic clamps.

4. Multiple blade ink knife according to claim 1, wherein the plastic jaws are maintained at a distance from the metal jaws and including at least one of resilient, domed screws and compressible intermediate layers in contacting relationship with the plastic jaws and metal jaws which maintain the plastic jaws at a distance from the metal jaws.

5. Multiple blade ink knife according to claim 2, wherein the elastic sealant in the groove is in replaceable relationship in said groove.

6. Multiple blade ink knife according to claim 2, wherein the groove with elastic sealant is formed 1–2 mm wider than the knife.

7. Multiple blade ink knife according to claim 2, wherein the elastic sealant consists of one of rubber and a soft plastic.

8. Multiple blade ink knife according to claim 1, including:

a flexible steel plate as said knife divided into multiple blades, with each blade having an upper surface;

said ink ductor pressing against said knife;

regulator elements operative to bend the knife differently in zones against said ink ductor, wherein said regulator elements are arranged on each blade; and wherein at least the blades are completely covered on the upper surface thereof with a flexible metal strip applied as a seal.

9. Multiple blade ink knife according to claim 8, wherein the metal strip consists of spring steel.

10. Multiple blade ink knife according to claim 9, wherein the metal strip is approximately 0.2 mm thick.

11. Multiple blade ink knife according to claim 8, wherein the metal strip is adhesively bonded to the upper surface of the blades.

12. Multiple blade ink knife according to claim 8, wherein said blades have a working edge and include a weakening groove running parallel to the working edge.

13. Multiple blade ink knife according to claim 12, wherein said flexible steel plate includes a body portion and the blades are attached to the body portion, and wherein the weakening groove runs along the site of attachment of the blades to the body portion.

14. Multiple blade ink knife according to claim 12, including a knife holder, wherein said knife is connected to the knife holder, and wherein said weakening groove is positioned adjacent said knife holder.

* * * * *